US007161549B1

(12) United States Patent
Cuchanski et al.

(10) Patent No.: US 7,161,549 B1
(45) Date of Patent: Jan. 9, 2007

(54) SINGLE-APERTURE ANTENNA SYSTEM FOR PRODUCING MULTIPLE BEAMS

(75) Inventors: Michael Cuchanski, Newtown, PA (US); Gerard Joseph Matyas, Bala Cynwyd, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 6 days.

(21) Appl. No.: 10/951,880

(22) Filed: Sep. 29, 2004

Related U.S. Application Data

(60) Provisional application No. 60/507,722, filed on Sep. 30, 2003.

(51) Int. Cl.
*H01Q 13/00* (2006.01)

(52) U.S. Cl. ..... 343/781 CA; 343/781 P

(58) Field of Classification Search ..... 343/781 CA, 343/781 P, 837
See application file for complete search history.

(56) References Cited

U.S. PATENT DOCUMENTS 5,790,077 A * 8/1998 Luh et al. ..... 343/781 P
5,912,645 A * 6/1999 Wight et al. ..... 343/700 MS
6,031,507 A * 2/2000 Aoki ..... 343/840
6,882,323 B1 * 4/2005 Peebles et al. ..... 343/781 R
2003/0234746 A1 * 12/2003 Tang et al. ..... 343/781 CA

OTHER PUBLICATIONS

"Development Of A 45 GHz Multiple-Beam Antenna For Military Satellite Communications", by K. Sudhakar Rao, et al., IEEE Transactions Of Antennas And Propagation, vol. 43, No. 10, Oct. 1995, pp. 1036-1047.

* cited by examiner

*Primary Examiner*—Shih-Chao Chen
(74) *Attorney, Agent, or Firm*—McDermott Will & Emery LLP.

(57) ABSTRACT

A novel single-aperture antenna system for producing multiple closely spaced or overlapping beams. The antenna system has multiple feeds for radiating energy, and a hyperboloidal or ellipsoidal main reflector responsive to the radiated energy for forming multiple beams. The main reflector is configured to form one beam for each of the multiple feeds in the antenna system.

20 Claims, 19 Drawing Sheets

SINGLE-APERTURE ANTENNA SYSTEM FOR PRODUCING MULTIPLE BEAMS

The present application claims priority of U.S. provisional patent application No. 60/507,722 filed on Sep. 30, 2003 and entitled "MULTI-BEAM ANTENNA SUBSYSTEM USING A DUAL REFLECTOR GEOMETRY WITH A HYPERBOLIC MAIN REFLECTOR."

TECHNICAL FIELD

The present invention relates to antenna systems, and more particularly to a single-aperture antenna for producing multiple closely spaced or overlapping beams.

BACKGROUND ART

In antenna systems, such as satellite antenna systems used, for example, in a global positioning system (GPS) or in a communications system, multiple closely spaced or overlapping pencil beams are produced to cover a particular country or a geographic area. For design purposes, the covered area may be defined as a polygon with edges corresponding to a geographical or political boundary. The coverage polygon should be fitted with a regular pattern of circular or slightly elliptical beams using a hexagonal or honeycomb lattice as the underlying basis. For example, FIG. 1 illustrates 10 beams covering the continental United States (CONUS).

The coverage area may comprise a group of neighboring countries, with each beam covering a different language or cultural region. In this situation, each beam must be centered optimally over its assigned region, with the fitting process unavoidably requiring irregular beam spacing, size, and even shape. For example, FIG. 2 shows a system of irregularly spaced beams placed over western and central Europe.

Therefore, there is a need to maximize the antenna gain (directivity) over the coverage area, to ensure that the minimum gain exceeds the specification required by the communications link budget. Hence, very closely spaced or overlapping beams should be formed. The amplitude vs. angle shape in current design practice has the approximate form of sin(x)/x or J1(x)/x, and sometimes is referred to as paraboloidal (when describing the pattern function within a few dB from peak). When a hexagonal lattice of circular beams with a paraboloidal [sin(x)/x] shape of radiation pattern is used, the conventional spacing between adjacent beams is approximately equal to the 3 dB beamwidth of the antenna. The minimum gain within the coverage area occurs at the triple crossover point of any three neighboring beams, and is about 4 dB below peak. When the beams are irregularly spaced, the beam spacing may be smaller or larger than the 3 dB beamwidth, and the crossover level may vary from 2 to 6 dB below peak if a paraboloidal [sin(x)/x] beam shape is used.

Optimum beam placement and compliant minimum gain are the primary goals for designing such antenna systems. However, other performance requirements and design constraints need to be considered, and may be equally important. For example, polarization, bandwidth, frequency reuse schemes, cross-polar isolation, co-polar (sidelobe) isolation for a frequency-reuse system of beams, maximum gain variation within a beam area, pointing error, antenna size, mass, and cost.

Traditionally, antennas having paraboloidal main reflectors are used for producing multiple beams. However, as illustrated in FIG. 3, when an antenna designer attempts to produce a system of closely spaced beams from a single antenna having a paraboloidal (P) main reflector, with beam spacing S and size B approximately equal to the 3 dB beamwidth of the antenna and with one feed per beam, the design problem becomes highly complex. The problem is that small beam spacing necessitates small feed size. Due to laws of optical ray tracing, the antenna geometry maps directly the spacing between beams into spacing between feeds. Feed elements with small aperture diameters produce feed radiation patterns with very large beamwidths that exceed the angle subtended by the reflector rim as viewed from the feed. As a result, a large fraction of power radiated by the feed flows outside of the reflector. This power is called the spillover loss. The fraction of feed power intercepted or captured by the reflector is called the spillover efficiency. With the feed diameter constrained to a small value by the beam layout, the spillover efficiency is typically less than 50%, i.e. the spillover loss is quite large, e.g. in the range of 3 to 5 dB. Except under special circumstances, an antenna design with such a poor efficiency is not acceptable.

It is possible to increase the feed size by selecting antenna geometry with a larger F/D ratio, where F is the focal length of the reflector, and D is the aperture diameter of the reflector. A typical value of this ratio for practical designs is F/D=1.0. Since aperture diameter D is fixed by the specified beamwidth of the pencil beams, a larger F/D ratio is achieved by increasing the focal length F. A larger F/D ratio increases the proportionality constant relating the feed spacing to the beam spacing. A feed with a larger diameter produces a feed pattern with a narrower beamwidth. However, when the focal length is increased, the angle subtended by the reflector rim becomes smaller (as viewed from the feed, which is now at a greater distance). The feed pattern is more focused, but the angular area intercepted by the reflector becomes smaller. Therefore, the spillover efficiency remains just as bad as for the traditional F/D ratio, or improves by an insignificant amount.

Conversely, it is possible to increase the angle subtended by the reflector by decreasing the F/D ratio, i.e. selecting antenna geometry with a shorter focal length F. However, a smaller F/D decreases the proportionality constant relating the feed spacing to the beam spacing. Hence, smaller feeds with a larger beamwidth should be used. The angular area intercepted by the reflector becomes larger, but because the feed pattern is less focused, the spillover efficiency again has not improved. Moreover, other design constraints associated with small feed size need to be carefully considered, for example propagation cutoff in feed waveguide, mutual coupling, and input impedance matching.

Accordingly, since the beams are closely spaced or effectively overlap, the feed apertures in the feed plane (the focal plane images of the beam areas) should also overlap. But this is impossible since two or three feeds cannot occupy the same area in the feed plane.

The above discussion shows that a conventional design of a multi-beam antenna using a single aperture and one feed per beam is handicapped by an extremely poor efficiency, with the spillover loss exceeding 3 dB. Depending on the antenna geometry, feed size, and feed type, other losses may also become significant: loss due to mutual coupling and loss due to power reflected from the feed input (input match).

To overcome the design difficulties described above, the conventional methodology uses an antenna system with multiple apertures. As illustrated in FIG. 4, in the antenna system with multiple apertures, large feeds may be distributed among three reflector antennas. In each antenna, the main reflector has a paraboloidal surface with a diameter defined by the beamwidth of the pencil beam with an F/D ratio approximately equal to 1.0. As alternate feeds are distributed among three separate feed planes belonging to different independent reflector antennas, they do not interfere. For a hexagonal beam/feed lattice, with a three-aperture solution, the feed diameter can be 1.73 times larger than the feed diameter for the one-aperture solution; for a four-aperture configuration, the feed diameter is two times larger. Therefore, the feed pattern beamwidth is either 1.73 or 2.0 times narrower, the feed radiation is much better focused on the reflector and the spillover efficiency improves, with the spillover loss dropping to around 0.5–0.6 dB.

An example of a simple three-aperture design producing a cluster of seven beams on a hexagonal lattice is illustrated in FIG. 5 that shows a perspective view of the three antennas and their feeds mounted on a spacecraft body. Each antenna has a single offset paraboloidal reflector, and one or multiple feeds that radiate electromagnetic energy illuminating the respective reflector. For example, antenna 1 may comprise a reflector 12 illuminated by energy radiated by a single feed 14, antenna 2 may comprise a reflector 16 illuminated by energy radiated by a feed cluster 18 composed of three feeds, and antenna 3 may have a reflector 20 and a feed cluster 22 composed of three feeds. Also, FIG. 5 shows various elements of spacecraft environment, such as solar panels, sensors, other antennas (not related to producing the beams discussed above), etc.

FIG. 6 shows a seven-beam layout produced by the antenna system shown in FIG. 5. The center beam (Beam 1) is radiated by Antenna 1 having only one feed. Beams 2, 3, and 4 are produced by Antenna 2 having three feeds. Beams 5, 6, and 7 are generated by Antenna 3 using its three feeds.

FIG. 7 shows the feed apertures projected onto a common fictitious plane defined as a union of the three actual feed planes. There is a one-to-one correspondence between each beam in FIG. 6 and the feed represented in FIG. 7. In particular, central beam 1 is produced by the feed 14 of antenna 1 (B-1, A-1), beams 2, 3 and 4 may correspond to the 3 feeds (B-2, A-2; B-3, A-2; and B-4, A-2) of the cluster 16 in antenna 2, and beams 5, 6 and 7 may correspond to the 3 feeds (B-5, A-3; B-6, A-3; and B-7, A-3) of the cluster 22 in antenna 3. As shown in FIG. 7, feeds belonging to the same antenna do not interfere with each other, but the superposed feeds of different antennas overlap.

A four-aperture design including four antennas operates on the same principle as the three-aperture design discussed above, except that the alternate feeds are slightly further apart. It is used when it becomes necessary to achieve better efficiency, lower sidelobes, and larger separation between beams requiring co-polar isolation in the context of a frequency reuse scheme.

However, improvements achievable by the multi-aperture solution come at a significant cost because three or four antennas are used instead of one. Multiple antennas require large physical space, which may not be available on the spacecraft body, need separate support structures, multiply production, testing, alignment times, etc.

Therefore, it would be desirable to create a single-aperture antenna with a single main reflector and multiple feeds to produce closely spaced or overlapping beams corresponding to the feeds of the antenna system.

SUMMARY OF THE DISCLOSURE

The present disclosure offers a novel single-aperture antenna system for producing multiple closely spaced or overlapping beams. The antenna system includes multiple feeds for radiating energy, and a hyperboloidal or ellipsoidal main reflector responsive to the radiated energy for forming multiple beams. The main reflector is configured to form one beam for each of the multiple feeds in the antenna system.

In accordance with an embodiment of the disclosure, the antenna system may further comprise a subreflector illuminated by the radiated energy produced by the multiple feeds and reflecting the radiated energy to the main reflector.

In accordance with another embodiment of the invention, the antenna system may be a single-reflector system, in which the multiple feeds are configured for illuminating the main reflector with the radiated energy.

In accordance with one aspect of the disclosure, the main reflector is configured for forming a hexagonal lattice of beams.

In accordance with another aspect of the disclosure, the main reflector is configured for forming a cluster of closely spaced or overlapping pencil beams.

In accordance with a further aspect of the disclosure, the feeds may be irregularly spaced and have different aperture diameters for forming beams covering pre-determined regions.

Additional advantages and aspects of the disclosure will become readily apparent to those skilled in the art from the following detailed description, wherein embodiments of the present disclosure are shown and described, simply by way of illustration of the best mode contemplated for practicing the present disclosure. As will be described, the disclosure is capable of other and different embodiments, and its several details are susceptible of modification in various obvious respects, all without departing from the spirit of the disclosure. Accordingly, the drawings and description are to be regarded as illustrative in nature, and not as limitative.

BRIEF DESCRIPTION OF THE DRAWINGS

The following detailed description of the embodiments of the present disclosure can best be understood when read in conjunction with the following drawings, in which the features are not necessarily drawn to scale but rather are drawn as to best illustrate the pertinent features, wherein.

DETAILED DISCLOSURE OF THE EMBODIMENTS

The present disclosure will be made with the example of satellite antenna systems. It will become apparent, however, that the concepts described herein are applicable to any antenna system for producing multiple closely spaced or overlapping beams.

Figure 1:
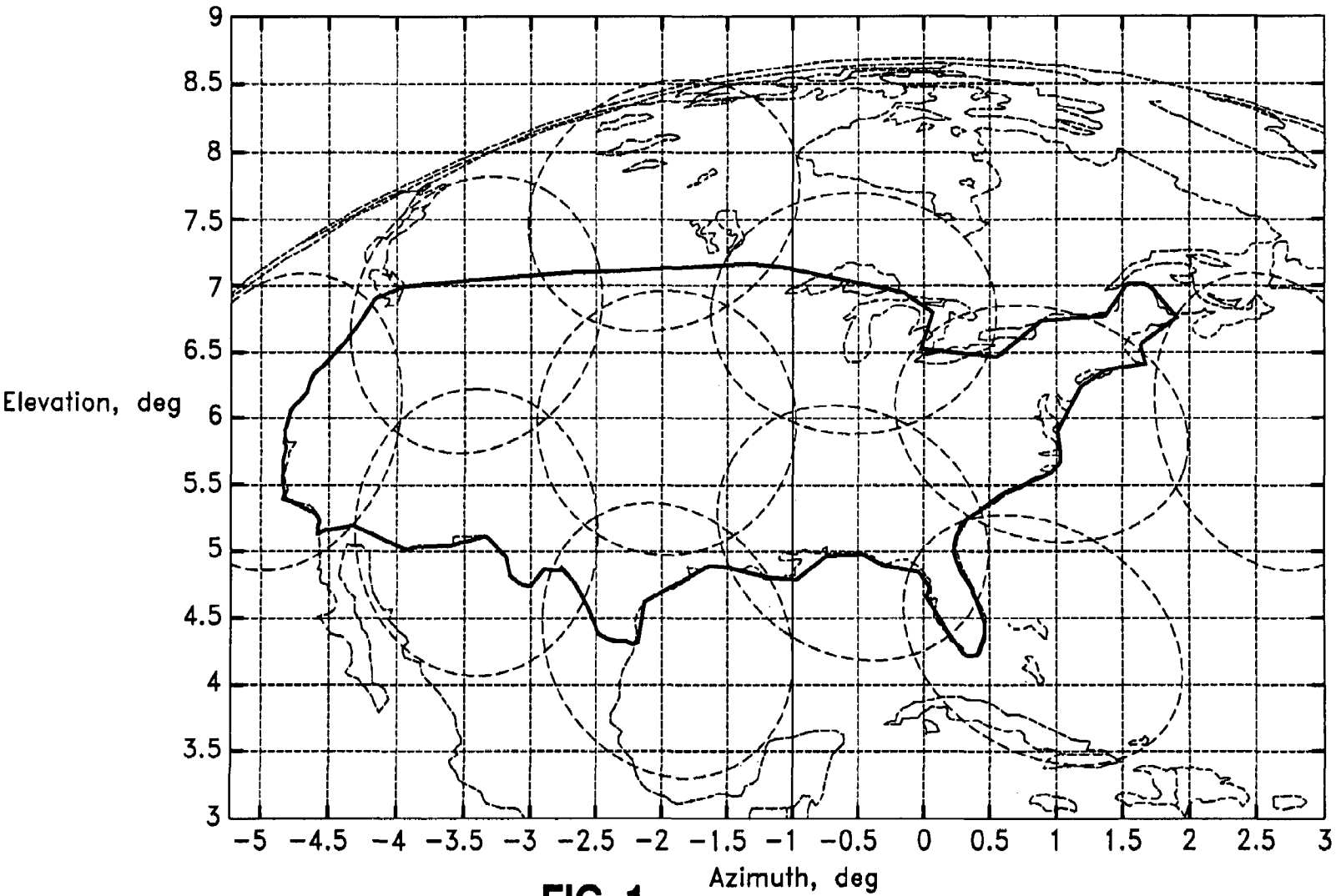
FIG. 1 (PRIOR ART)
FIG. 1 is a diagram illustrating multiple beams formed by antenna system to cover the continental United States.
Figure 2:
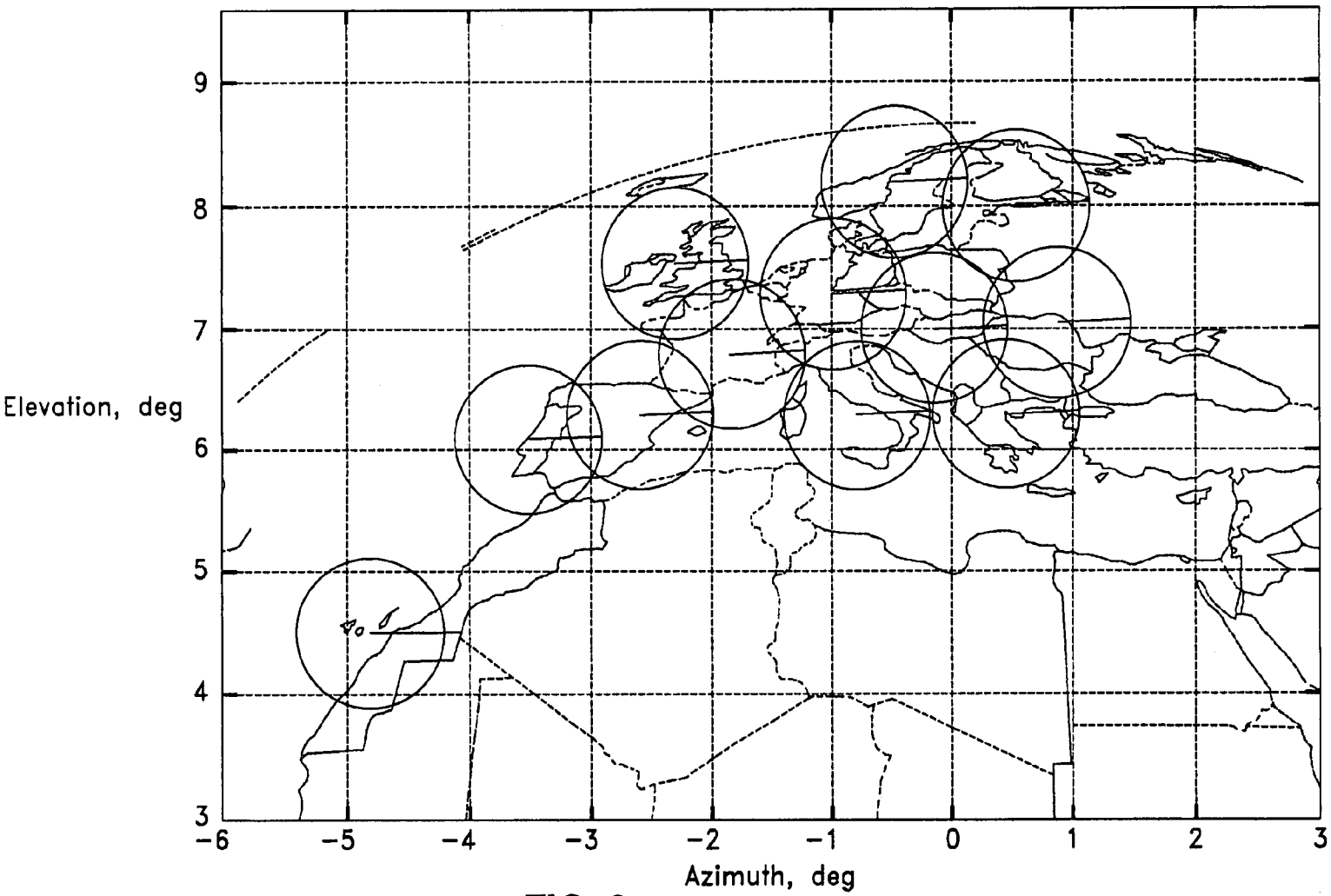
FIG. 2 (PRIOR ART)
FIG. 2 is a diagram showing a system of irregularly spaced beams placed over western and central Europe.
Figure 3:
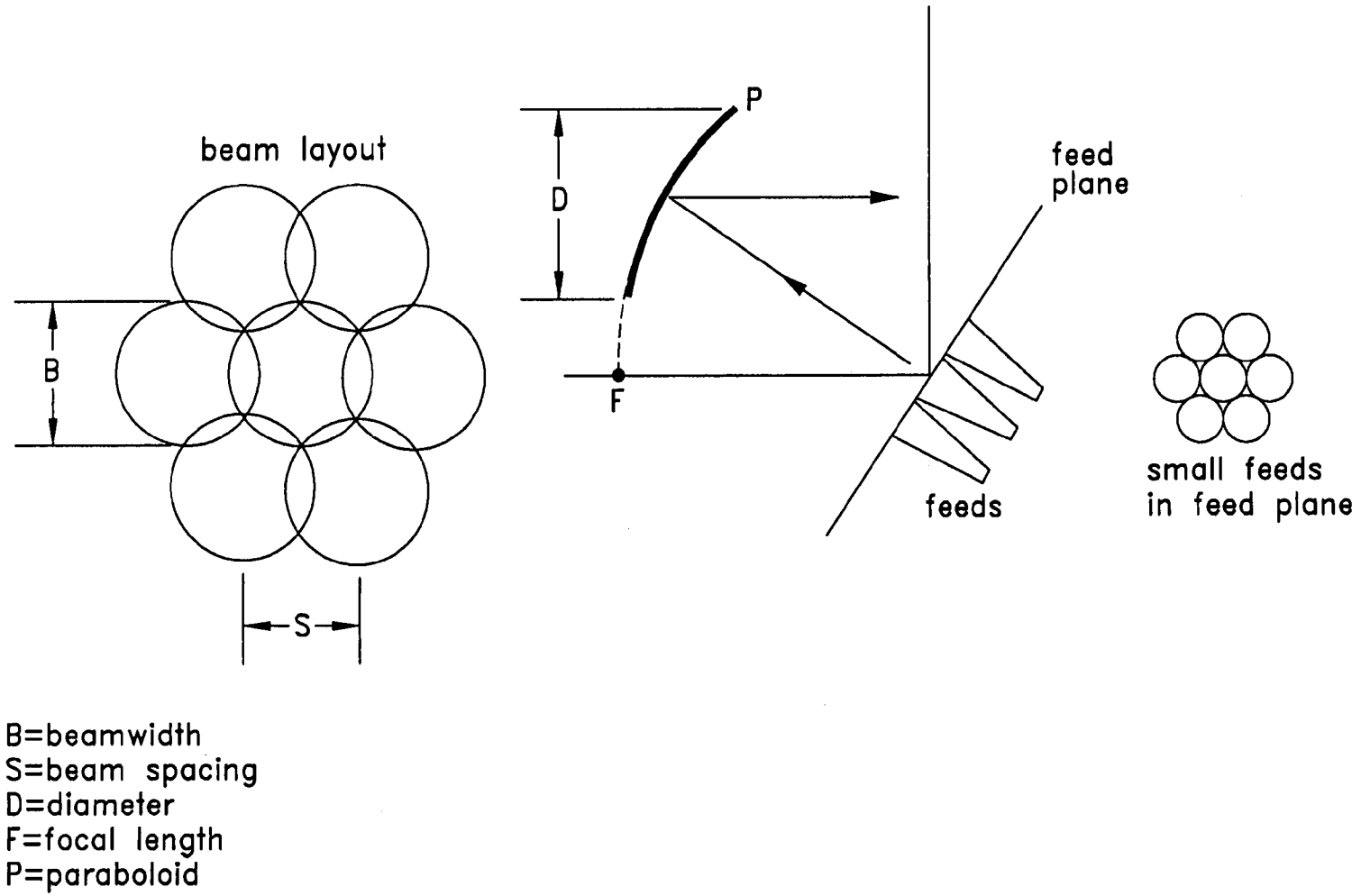
FIG. 3 (PRIOR ART)
FIG. 3 is a diagram illustrating design problems with paraboloidal main reflector in a single antenna.
Figure 4:
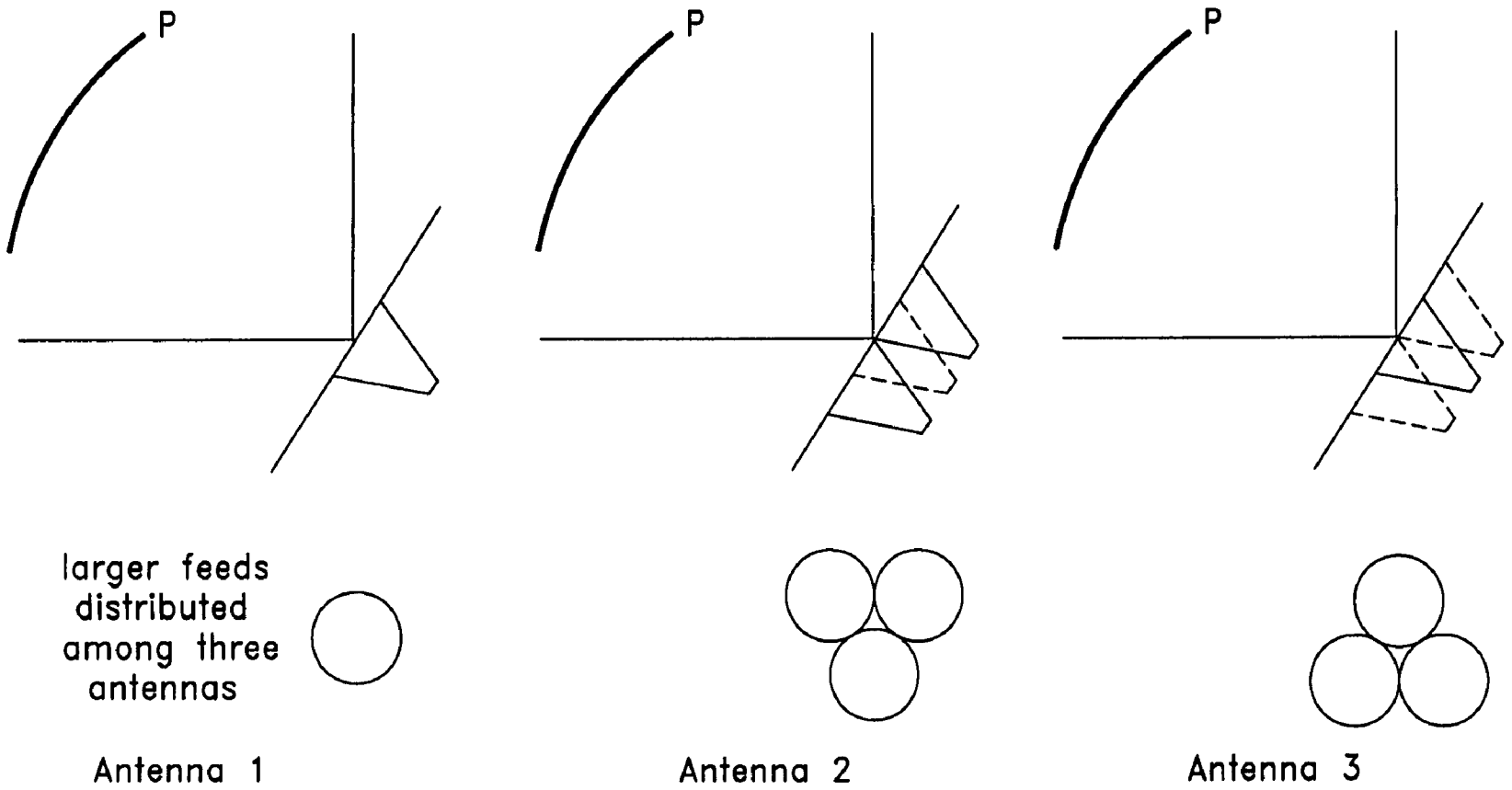
FIG. 4 (PRIOR ART)
FIG. 4 is a diagram illustrating a conventional multiple-aperture antenna system having multiple feeds distributed among antennas.
Figure 5:
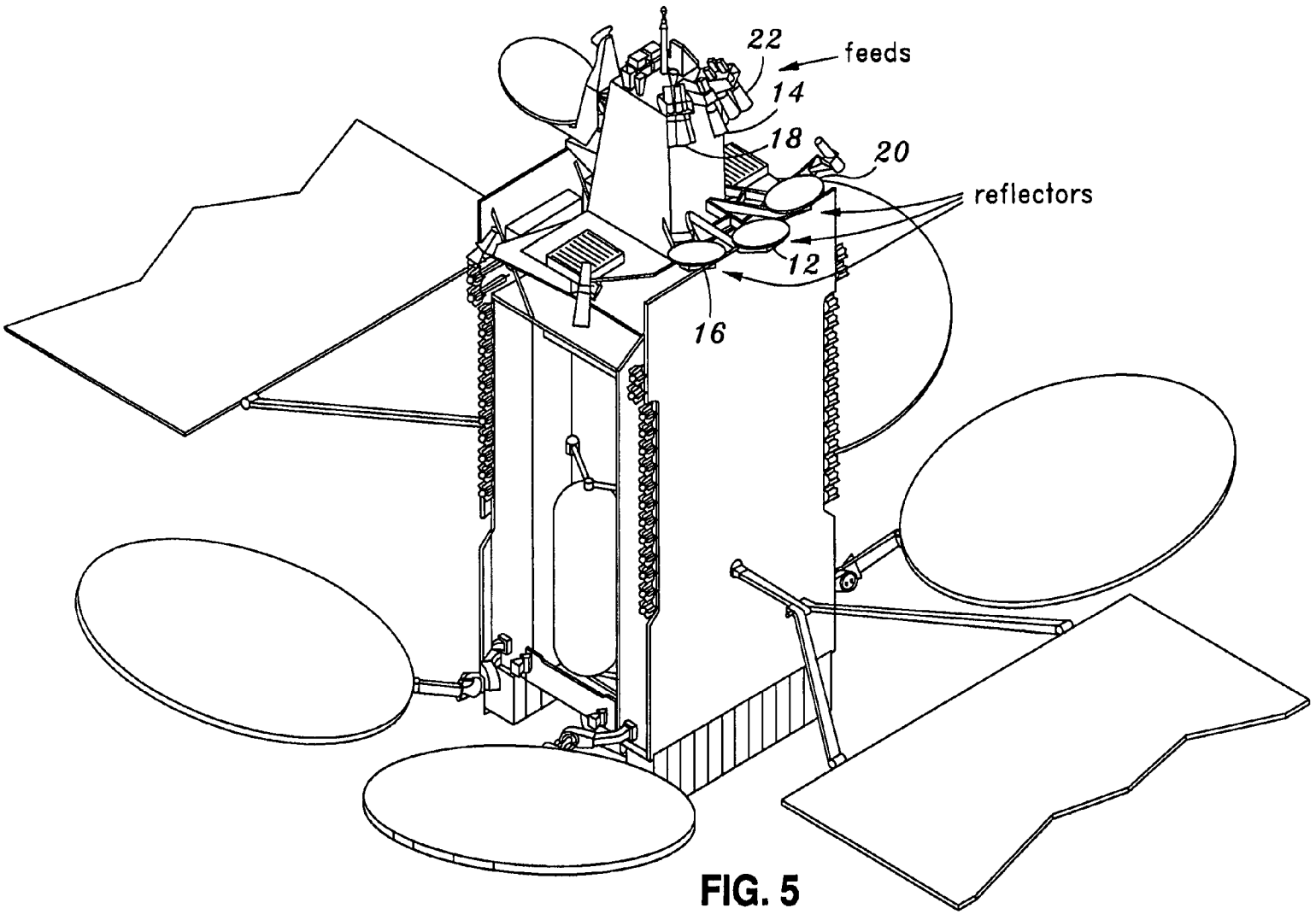
FIG. 5 (PRIOR ART)
FIG. 5 is a diagram illustrating a conventional antenna system including three antennas with paraboloidal main reflectors.
Figure 6:
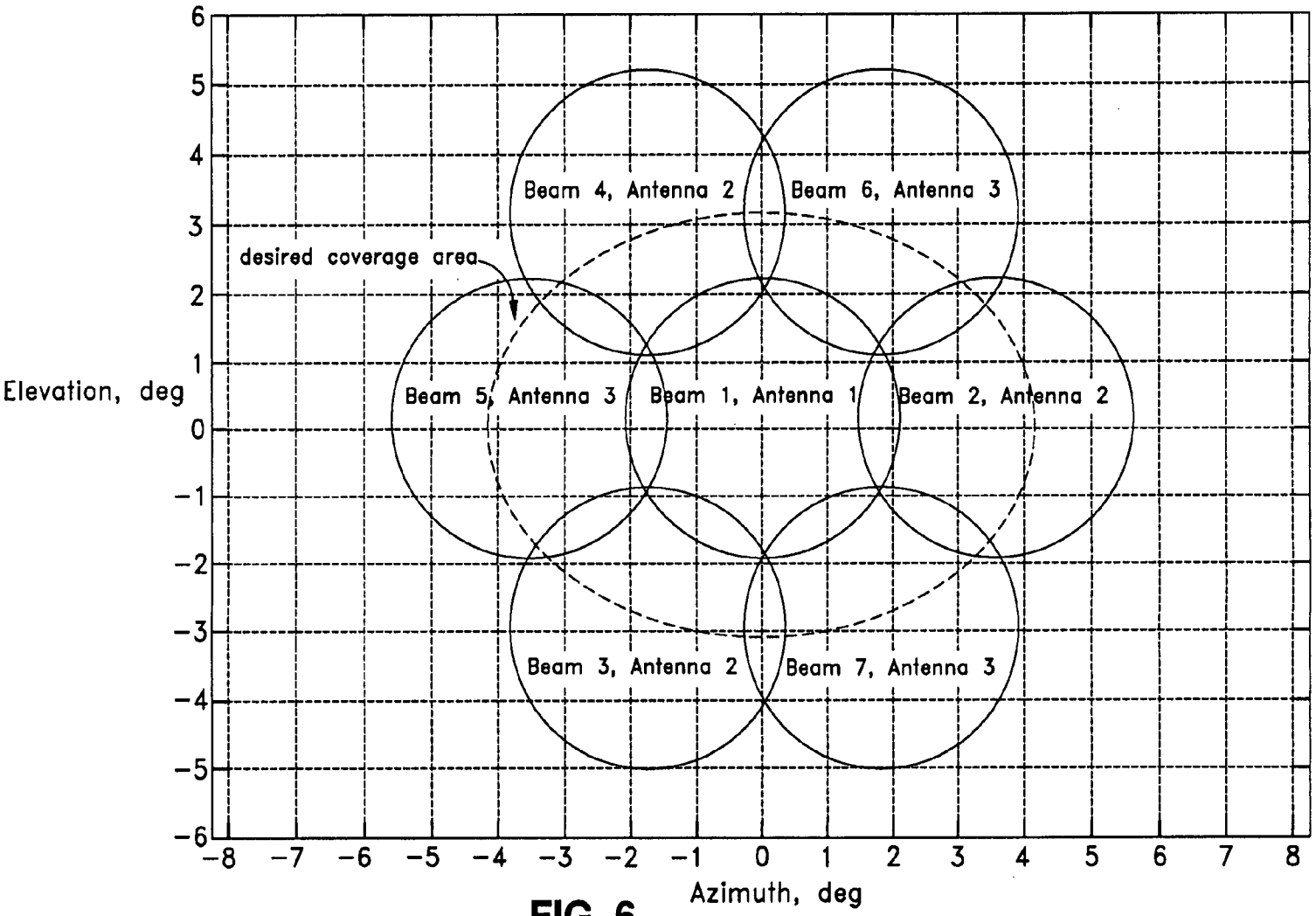
FIG. 6 (PRIOR ART)
FIG. 6 is a diagram showing beam contours produced by the conventional multiple-aperture antenna system.
Figure 7:
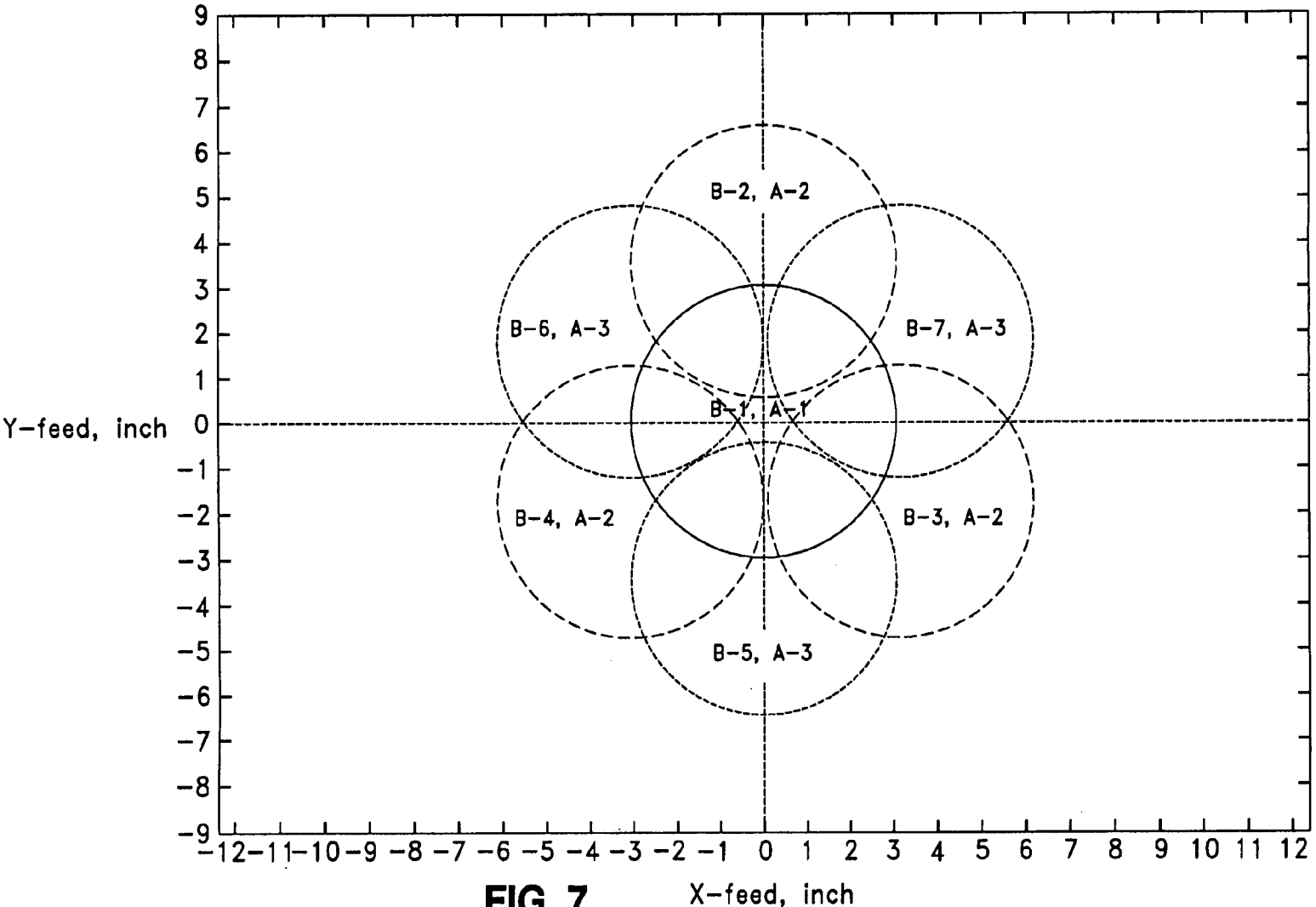
FIG. 7 (PRIOR ART)
FIG. 7 is a diagram illustrating feed apertures in the conventional multiple-aperture antenna system.
Figure 8:
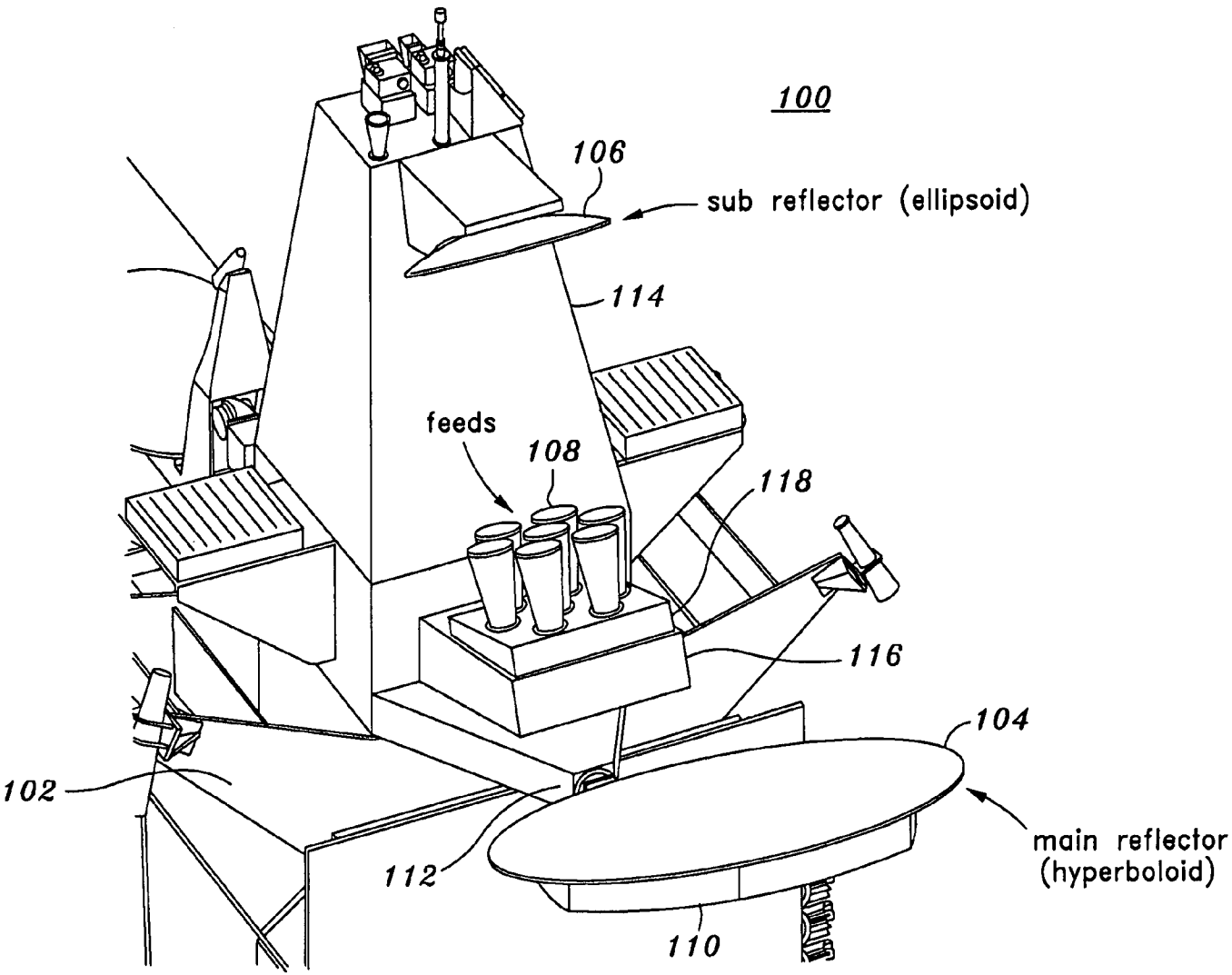
FIG. 8 is a diagram illustrating a dual-reflector antenna system of the present disclosure.

FIG. 8 illustrates a dual-reflector antenna system 100 of the present disclosure mounted on a spacecraft body 102. The antenna system 100 comprises a hyperboloidal main reflector 104, an ellipsoidal subreflector 106, and a feed subsystem composed of seven feeds 108. Alternatively, the main reflector 104 may have an ellipsoidal surface. Also, the subreflector 106 may be a hyperboloidal reflector.

The main reflector 104 is supported by a reflector mounting platform 110 carried by the spacecraft body 102, which also carries a reflector gimbal 112 for controlling the main reflector movement during deployment and alignment, a tower 114 supporting the subreflector 106, a feed mounting plate 116, and a feed assembly box 118. FIG. 8 also shows multiple elements of spacecraft environment, which are not related to the antenna system 100, such as earth sensors, an earth-coverage horn, and a bicone antenna installed on the top of the tower 114.

Figure 9:
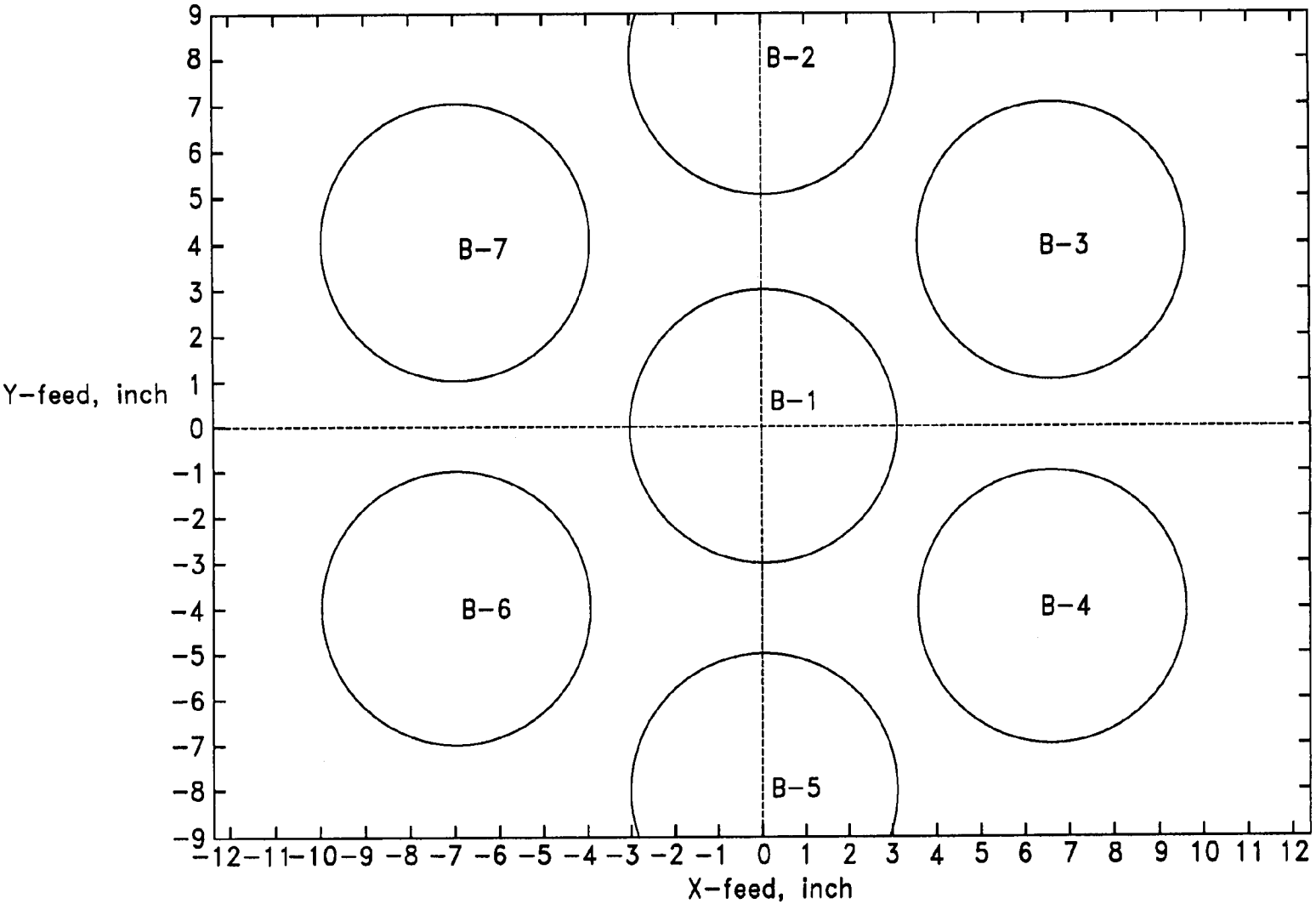
FIG. 9 is a diagram showing feed apertures in the dual-reflector antenna system of the present disclosure.
Figure 10:
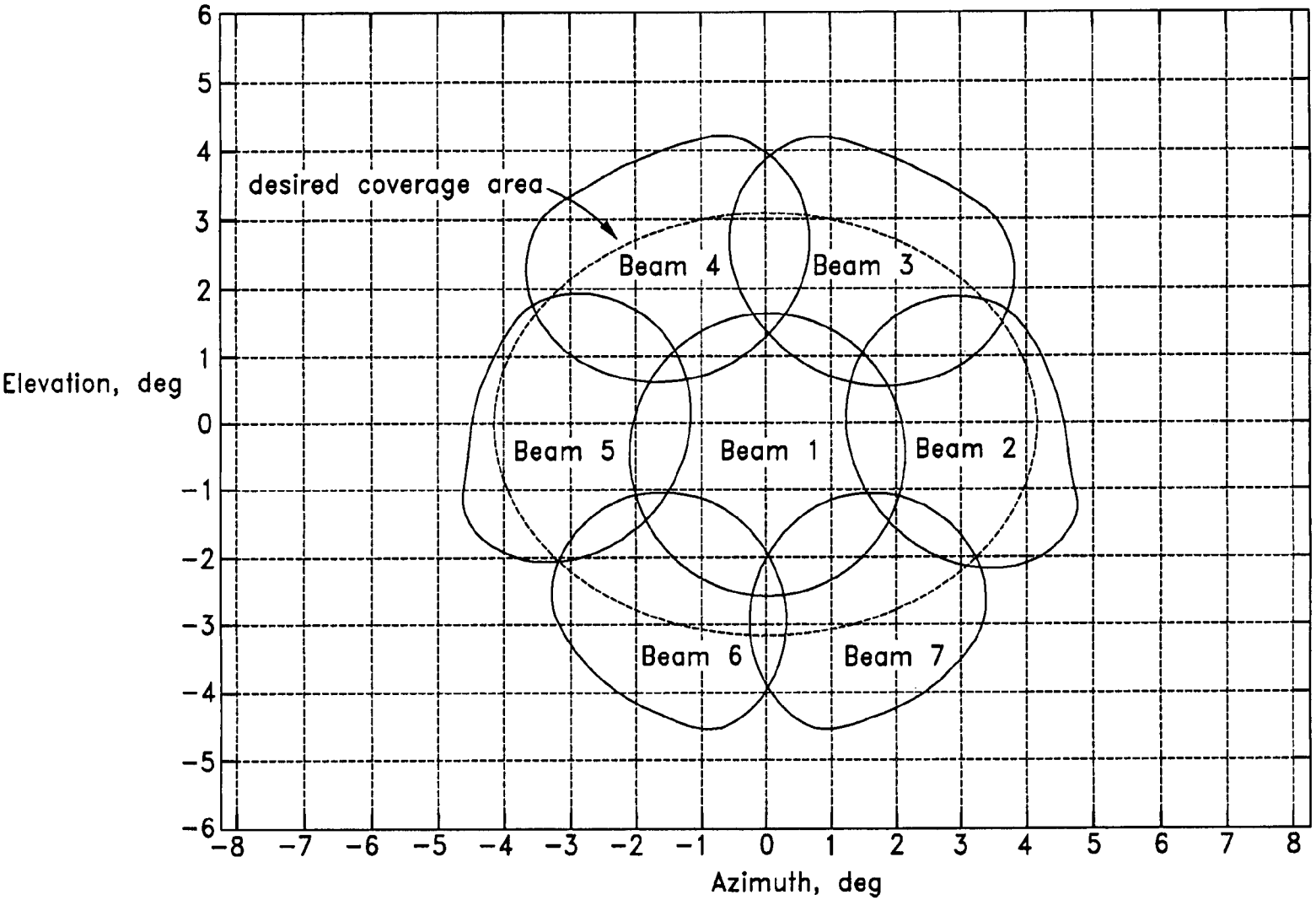
FIG. 10 is a diagram showing beam contours in the dual-reflector antenna system of the present disclosure.

The feeds 108 aimed at the subreflector 106 independently produce radiating energy illuminating the subreflector 106, which reflects the energy to the main reflector 104 forming the desired multiple beams representing the respective feeds 108. The apertures B-1 to B-7 of the feeds 108 projected onto a feed plane are shown in FIG. 9. FIG. 10 illustrates the contours of resulting overlapping beams 1 to 7 relative to the desired coverage area. One beam is formed for each of the feeds 108.

A hyperboloidal or ellipsoidal surface of the main reflector 104 makes it possible to produce multiple closely spaced or overlapping beams using a single-aperture antenna 100 with a single main reflector instead of multiple paraboloidal antennas illustrated in FIGS. 4–7. For example, when a hyperboloidal reflector differs only slightly from a paraboloidal reflector of the same focal length (i.e. when its eccentricity is about 1.05 to 1.10), it radiates a wider well-focused beam with low sidelobes. The beamwidth of the antenna can be controlled by selecting an appropriate value of the reflector eccentricity, and the beam shape can be further adjusted by varying the feed edge taper (i.e. the feed size), until a "flat-top" pattern is achieved. This stage of the design requires numerical analysis of the antenna system performance. First, the antenna geometry must be refined using antenna analysis software. Then an iterative process is entered, where the desired beamwidth and pattern shape are obtained by optimizing the reflector surface parameters, the feed size and type, and possibly going back to make adjustments to the antenna geometry.

A hyperboloidal reflector has a number of advantages over possible alternatives. It has a smooth diverging surface that is flatter than the surface of a paraboloidal reflector. Therefore, it generates low cross-polar radiation and produces low scan loss (beam distortion) with beam scan angle away from center. The principal ray direction is at an angle away from the reflector axis of revolution, i.e. away from the feed or subreflector. This property minimizes scattering from the feed cluster and its support structure, or from the top edge of the subreflector. Because the wider "flat-top" beam shape is generated in part via a mechanism that creates a reflector aperture distribution with a phase error, the resulting beamwidth is nearly constant vs. frequency over the operational bandwidth.

As discussed above, an ellipsoidal reflector can be used in lieu of a hyperboloidal reflector. However, since an ellipsoid is a converging surface, its cross-polar radiation is usually higher. The principal direction of radiation is tilted towards the feed or subreflector, increasing the potential for interference due to scattering from these structures.

Figure 11:
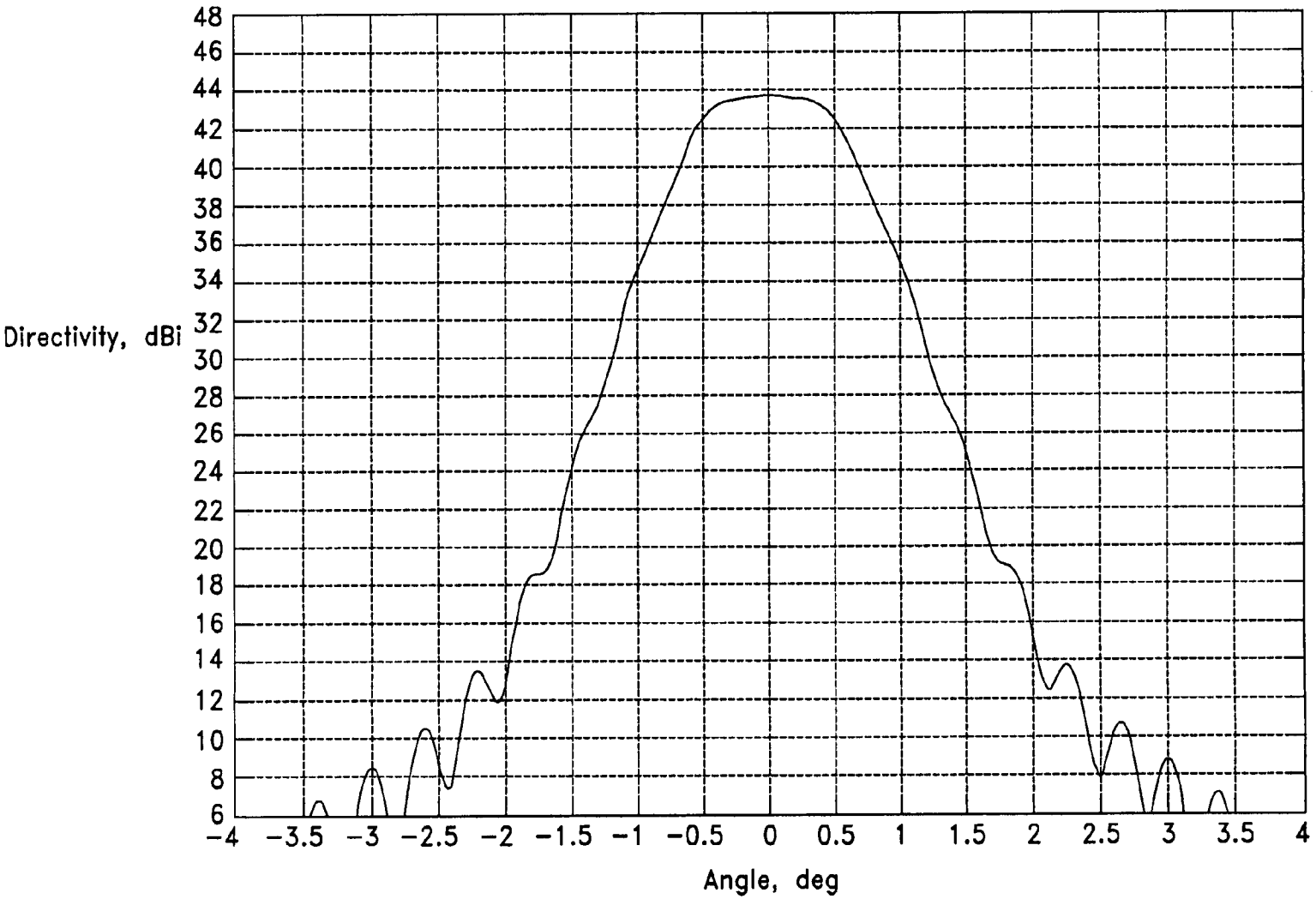
FIG. 11 is a diagram illustrating a flat-top radiation pattern produced by the antenna system of the present disclosure.

The antenna of the present disclosure is very efficient, with spillover loss in the range of 0.2 to 0.4 dB. As discussed above, a conventional single-aperture design suffers from spillover loss of 3 to 5 dB, and a multi-aperture solution produces spillover loss of about 0.6 dB. As shown in FIG. 11, the antenna with a hyperboloidal main reflector of the present disclosure produces a pencil beam radiation pattern having an amplitude vs. angle form which nearly approaches an ideal "flat-top" pattern. This type of pattern ensures a higher minimum gain within the beam coverage area. The improvement is about 1 to 2 dB, depending on the beam distance from the antenna boresight direction. Co-polar sidelobe levels and undesirable cross-polar radiation are both low. An important characteristic of the antenna of the present disclosure is an inherently constant beamwidth as a function of frequency over typical bandwidths ranging from 2% to 13.5%.

Figure 12:
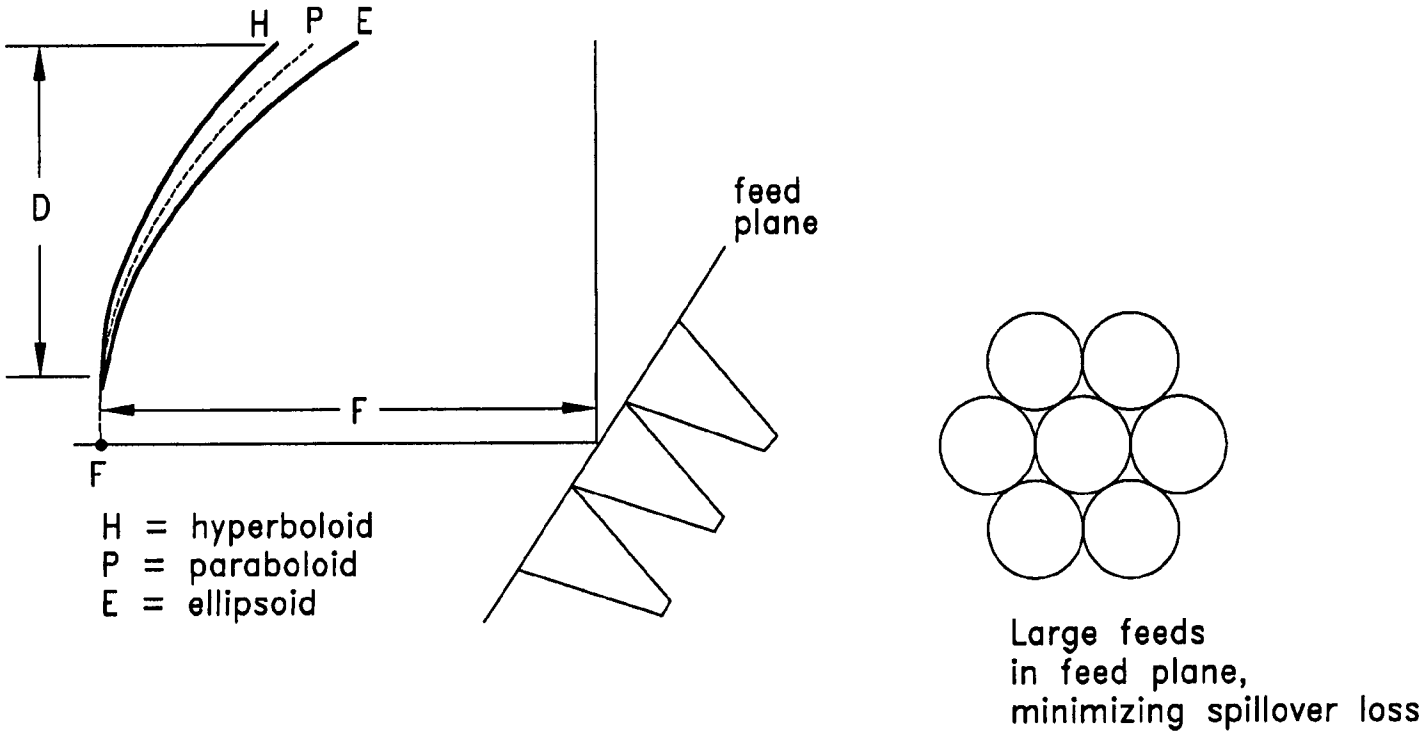
FIG. 12 is a diagram illustrating design considerations for using a hyperboloidal or ellipsoidal main reflector in a single-aperture antenna system of the present disclosure.

As illustrated in FIG. 12, in order to achieve the required beam shape and layout from feeds disposed in a single feed plane, aperture diameter D of the main reflector 104 may be two to three times larger than that normally used in conventional solutions. The reflector eccentricity of the antenna of the present disclosure is only slightly different from that of a paraboloidal antenna (P), i.e. for a hyperboloidal reflector (H), it is somewhat larger than 1.0, and for an ellipsoidal reflector (E), it is a little less than 1.0. From the viewpoint of reflector manufacture, making a hyperboloidal or an ellipsoidal reflector is no more difficult than a paraboloidal. However, there is a design issue that must be considered related to the direction of radiation. A ray originating at the focal point of the hyperboloidal or ellipsoidal reflector and incident at the center of the reflector surface (the principal ray) is not reflected parallel to the axis of revolution of the reflector, as it is for a paraboloidal reflector. For an offset hyperboloid, in the offset plane, the principal ray is reflected away from the feed or subreflector, at a small angle relative to boresight direction, and if extended backwards, it crosses the reflector axis of revolution behind the reflector. For an offset ellipsoid, the principal ray is at a small angle towards the feed (subreflector), and eventually it crosses the reflector axis of revolution in front of the reflector. In certain situations, it is possible to take advantage of this inherent beam steering; in general, however, it is necessary to re-point the antenna boresight in order to correctly position the direction of radiation. Finally, the beam shape becomes non-circular for beams scanned away from the principal ray direction. As the distance from the center increases, the beam outline (the minimum gain contour) changes to an ellipse, with major axis frequently at an angle to horizontal. For large scan angles, the beam shape is more distorted, and resembles a cardioid. This behavior is case dependent The process of designing the single-aperture antenna of the present disclosure starts with the given values of the antenna beamwidth (B), i.e. the angular diameter of the beam area, the beam spacing (S), wavelength (λ), minimum gain requirements, coverage area, and other specifications related to polarization, isolation requirements, etc. The first step is to estimate the antenna diameter. An aperture diameter (D) may be about two to three times larger than that defined by the beamwidth. With the beamwidth expressed in radians and the diameter in wavelengths, the approximate value of D is: $D=3\times(\lambda/B)$.

The ratio λ/B represents the diameter that would normally be used in a conventional design. For example, if the beam diameter B=1.15 degree=0.02 radian, frequency=29.5 GHz, i.e. wavelength λ=0.4 inch, then $D=3\times(0.4/0.02)=60$ inch.

The next step is to define the focal length (F). Selection of the focal length involves consideration of the angle subtended by the reflector as viewed from the rim, the anticipated feed diameter, and the beam spacing. A longer focal length, i.e. a larger F/D ratio, will reduce the angle subtended by the reflector rim, but also increase the spacing between feeds corresponding to the spacing between beams. Large feed diameter produces a more focused feed radiation, usually expressed as the feed edge taper in dB at the reflector rim angle, thus improving antenna spillover efficiency. This tradeoff may require some engineering judgment and experience, and may take a few iterative evaluations of candidate antennas.

The feed spacing (T) is related to the beam spacing (S) and the focal length (F) as follows: $T=F\times(S/BDF)$, where S is expressed in radians, and BDF is a dimensionless beam deviation factor with a value slightly less than 1.0, which accounts for the reflector curvature. If beam spacing S=1.0 deg=0.0175 radian, and F/D ratio=1.4, then F=84 inch, which in turn yields the feed spacing T=1.6 inch=4 wavelengths at 29.5 GHz (assuming BDF=0.9). For a reflector system with an F/D ratio=1.4, the angle from the reflector center to the reflector rim is about 20 deg, as seen from the feed on focus. With a feed diameter of 4 wavelengths, and using a dual-mode conical feed (Potter feed), a feed edge taper is around 16 dB. That is, the feed pattern amplitude is 16 dB below peak at the reflector rim. Therefore, nearly all of the power radiated by the feed will be captured by the reflector; ensuring excellent spillover efficiency. The above considerations may have to be refined by performing subsequent analysis of the antenna performance.

Once the antenna geometry and the reflector surface are optimized so that the beam from a feed on focus has the required beamwidth and shape, the process of placing the other feeds can begin. If the task is to fill a coverage polygon with a number of beams, then the feeds are arranged on a regular hexagonal grid, and the array is positioned to fit the coverage area in an optimum sense. The position of an individual beam is usually of a secondary importance, the key criterion is meeting a minimum gain requirement over the coverage polygon.

The problem of feed placement becomes more difficult if each beam is assigned to a specific area (for example, country or cultural region). In this case, it would be desirable to provide irregular beam spacing and beamwidth.

Figure 13:
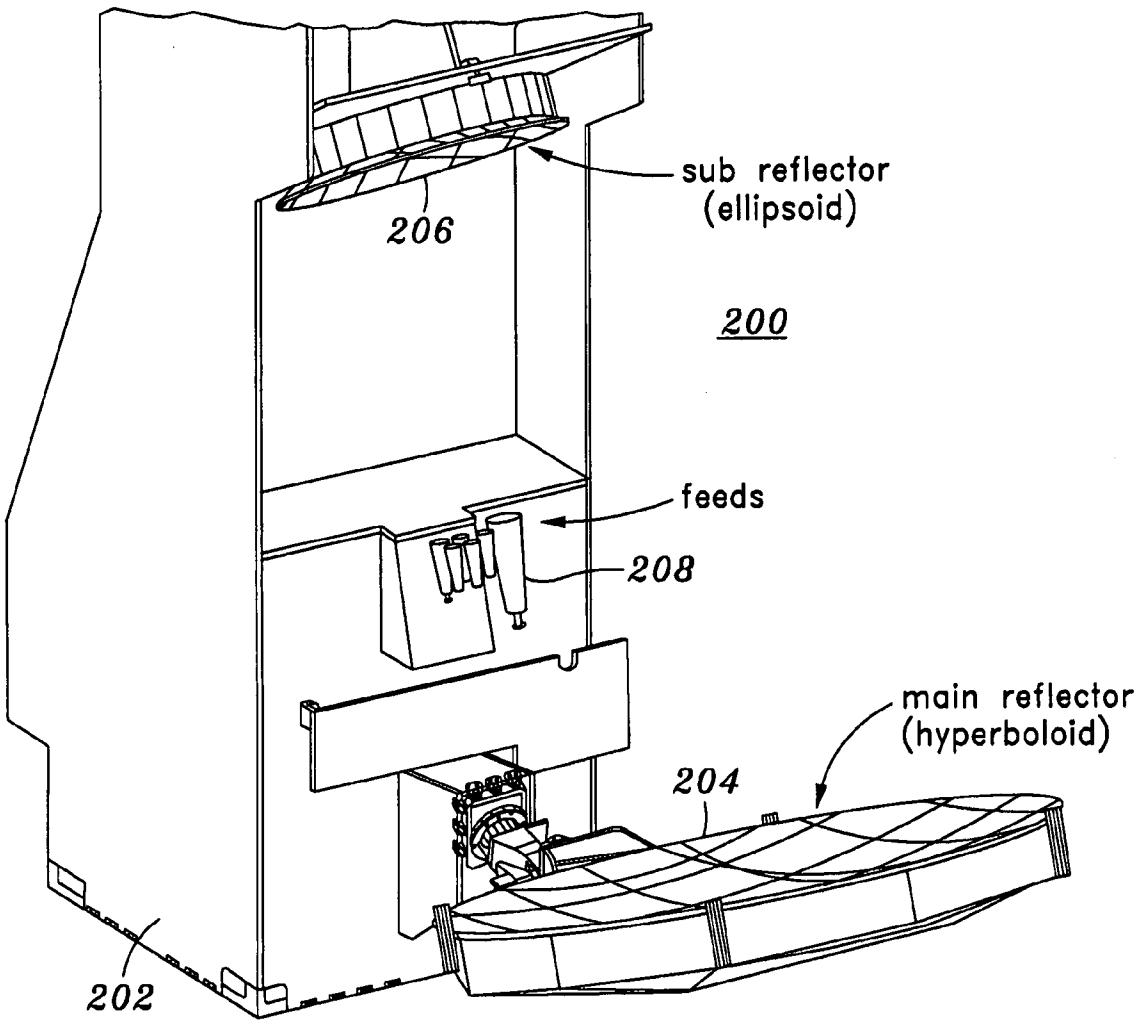
FIG. 13 is a diagram illustrating elements of an antenna system with irregularly spaced feeds having different aperture diameters in accordance with the present disclosure.
Figure 14:
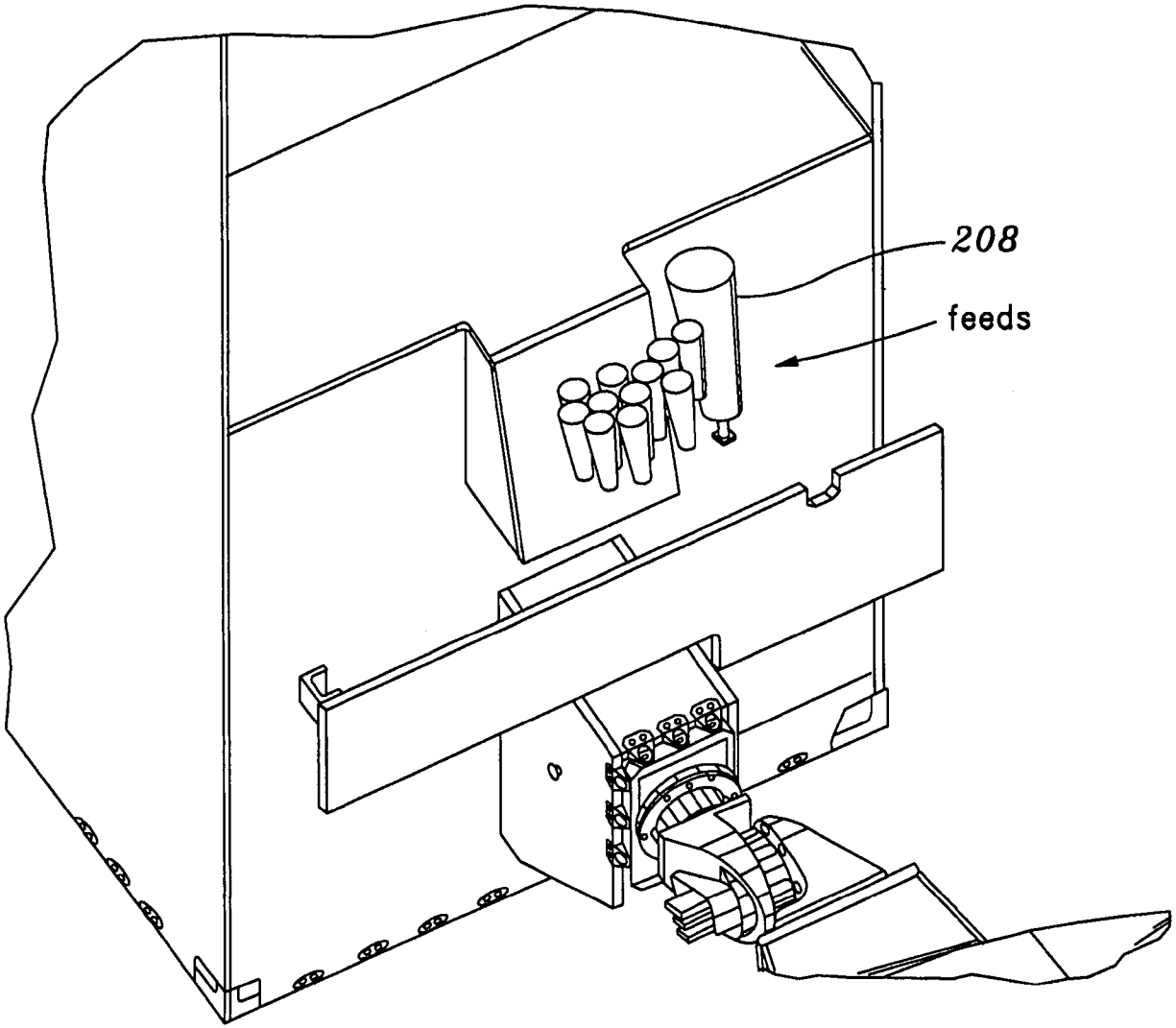
FIG. 14 is a close-up view of the irregularly spaced feeds with different aperture diameters.
Figure 15:
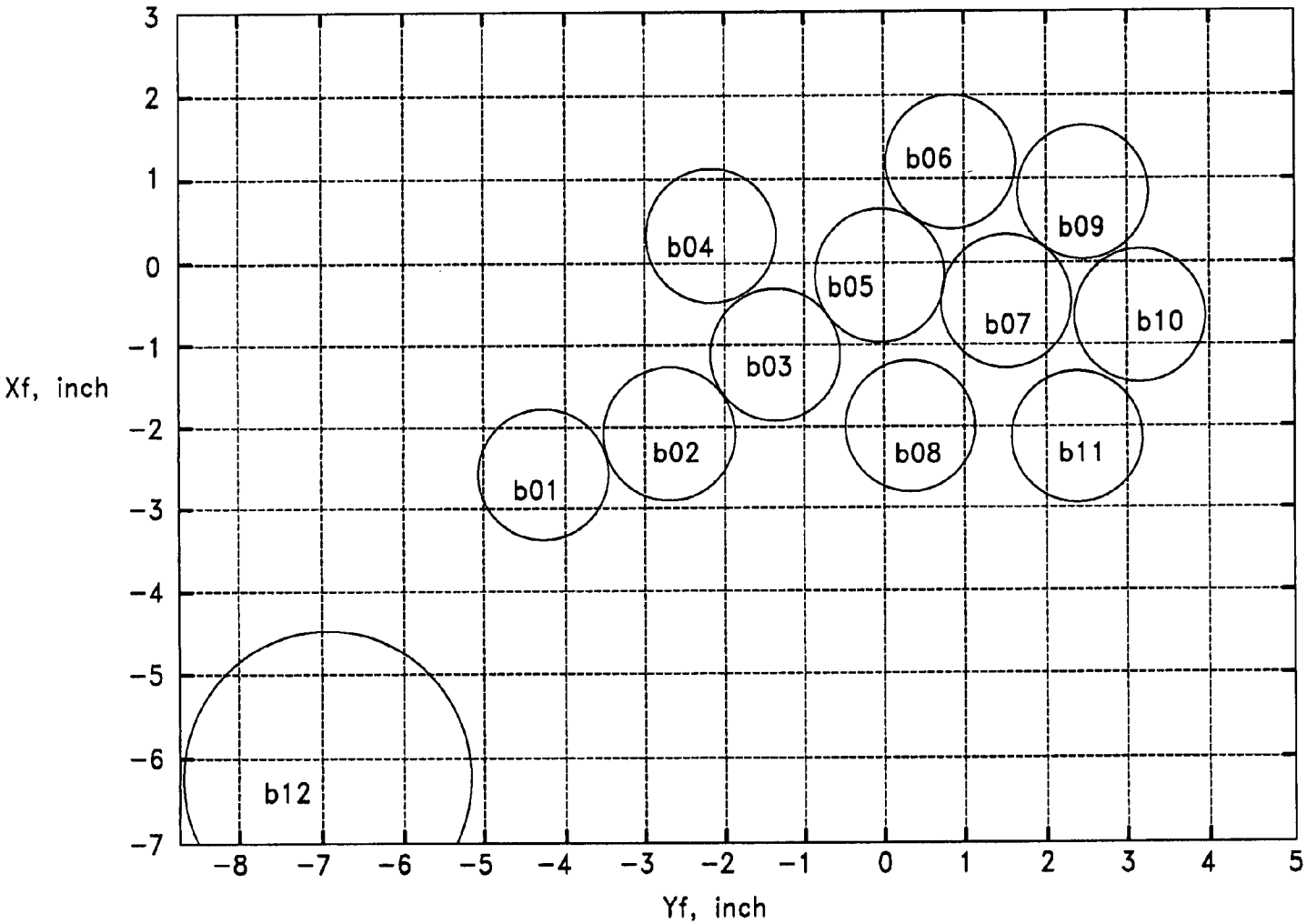
FIG. 15 is a diagram illustrating feed apertures of the antenna system with irregularly spaced feeds.
Figure 16:
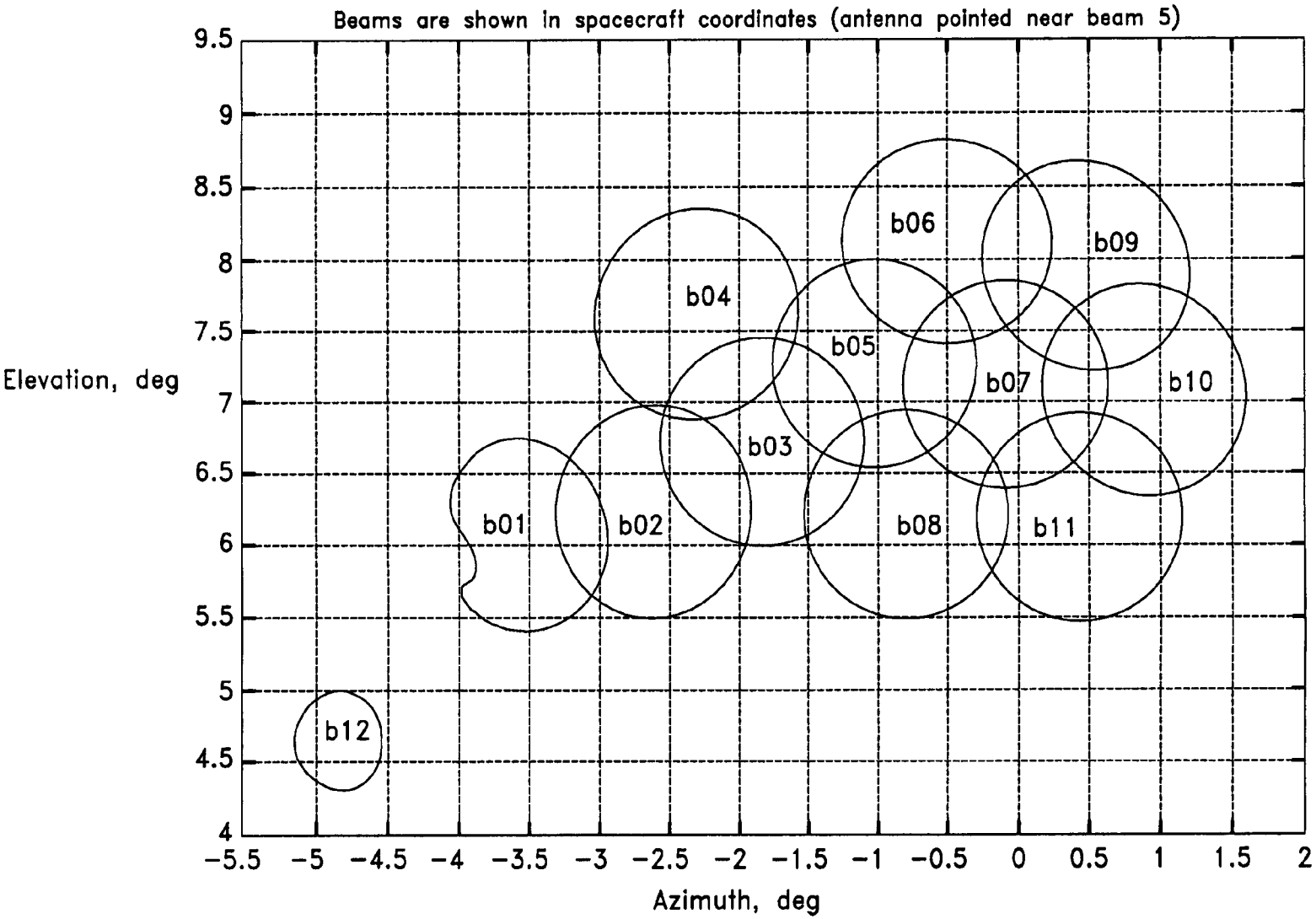
FIG. 16 is a diagram illustrating contours of the beams produced by the antenna system with irregularly spaced feeds.

FIG. 13 illustrates essential elements of a dual-reflector antenna system 200 having multiple feeds with irregular spacing and different aperture diameters. Similarly to the antenna system 100 shown in FIG. 8, the antenna system 200 is mounted on a spacecraft body 202, and comprises a main reflector 204 with a hyperboloidal surface and an ellipsoidal subreflector 206. However, instead of regularly spaced feeds 108 having the same aperture diameters, the antenna 200 has 12 feeds 208 with irregular spacing and different aperture diameters. FIG. 14 shows a close-up view of the feeds 208. FIG. 15 illustrates the outlines b01 to b12 of the feeds 208 in the feed plane. The positions of the feeds 208 are selected to position the beams corresponding to the respective feeds 208 over specific regions. The beam contours representing the feeds b01 to b12 are shown in FIG. 16. The feed positions can be estimated from the geometry of the antenna, by mapping the beam layout into the feed plane with the aid of simple approximate ray-tracing formulas.

Figure 17:
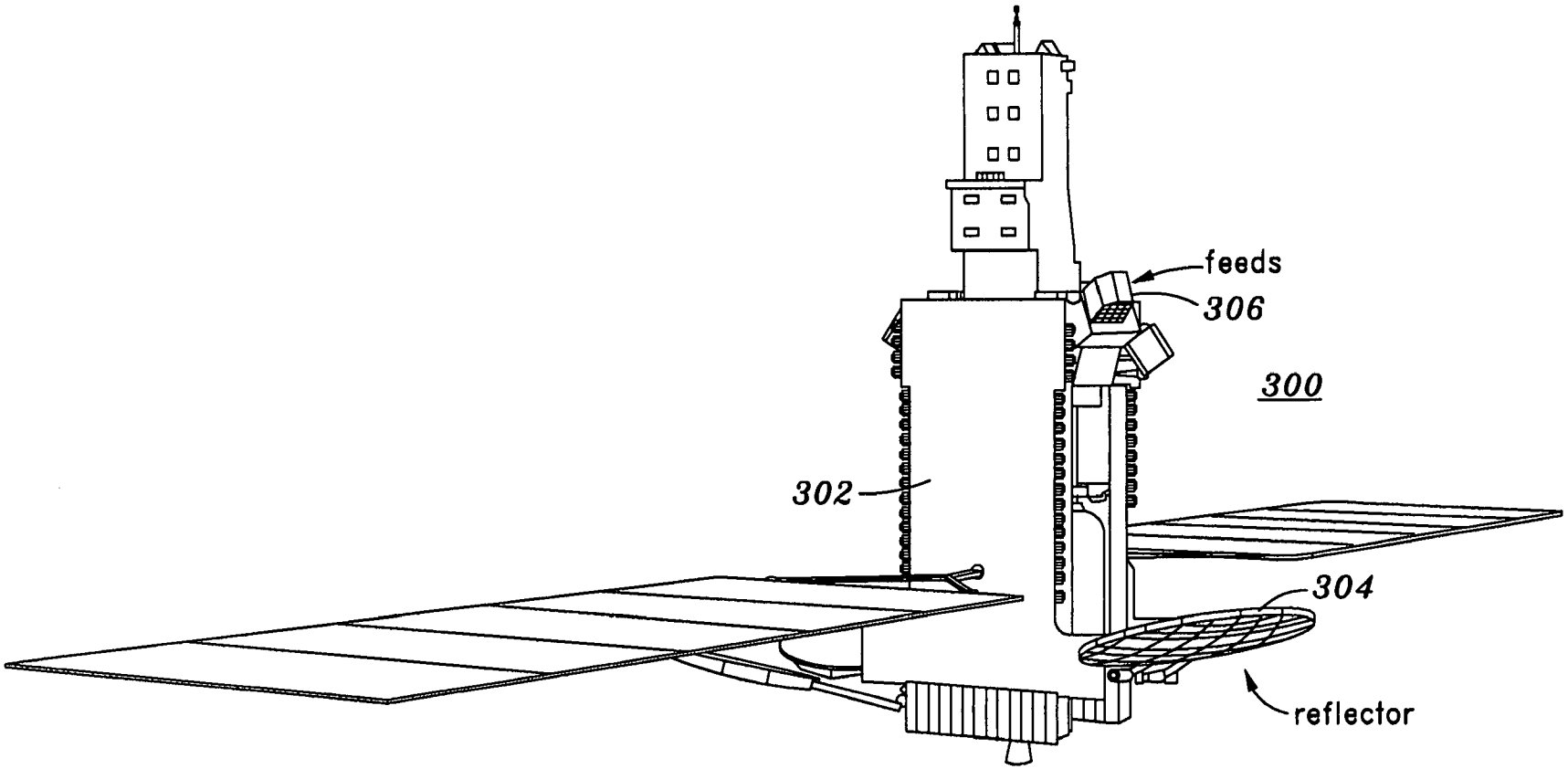
FIG. 17 is a diagram illustrating an antenna system having a single offset reflector of the present disclosure.
Figure 18:
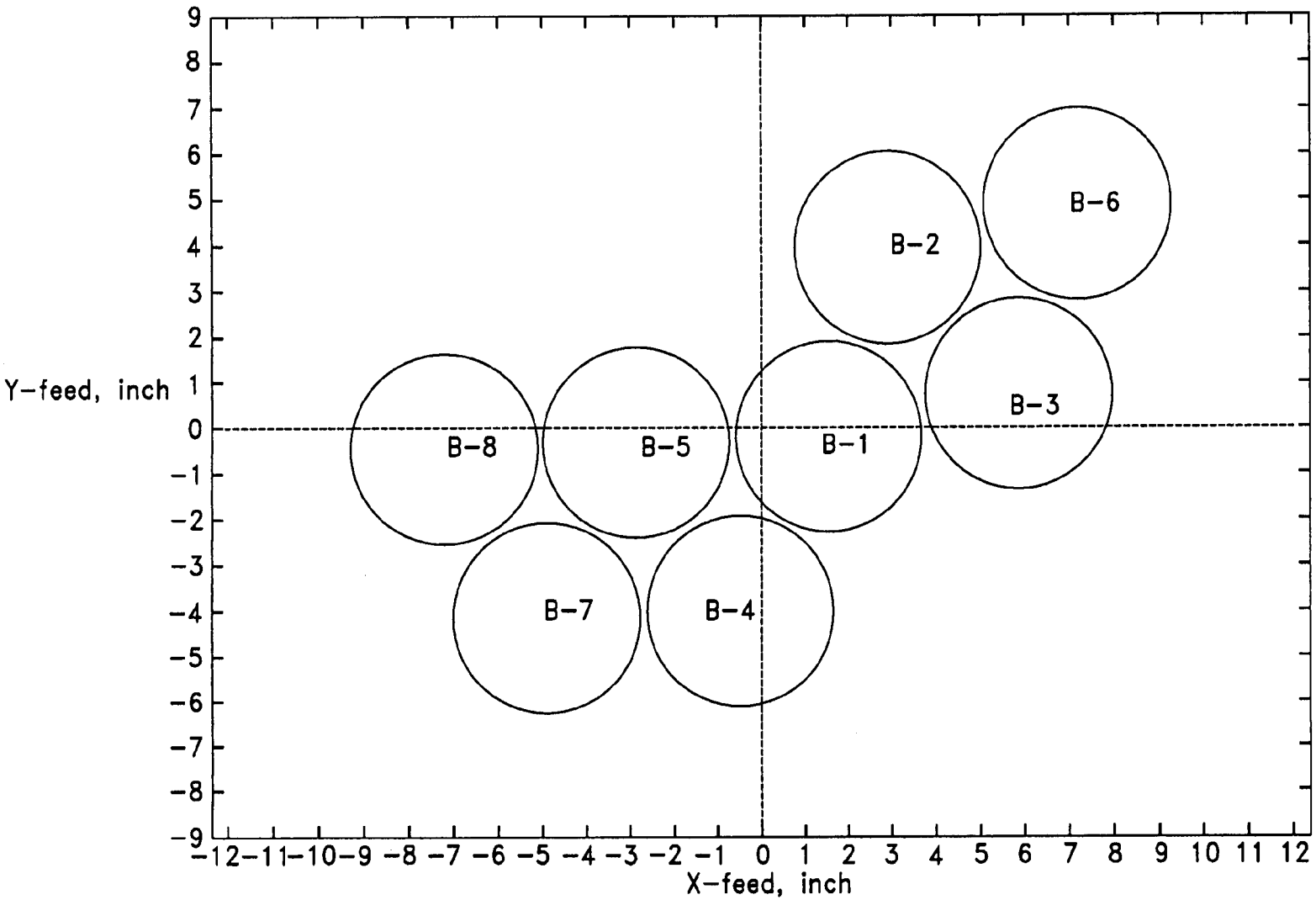
FIG. 18 is a diagram illustrating feed apertures of the antenna system having a single offset reflector.
Figure 19:
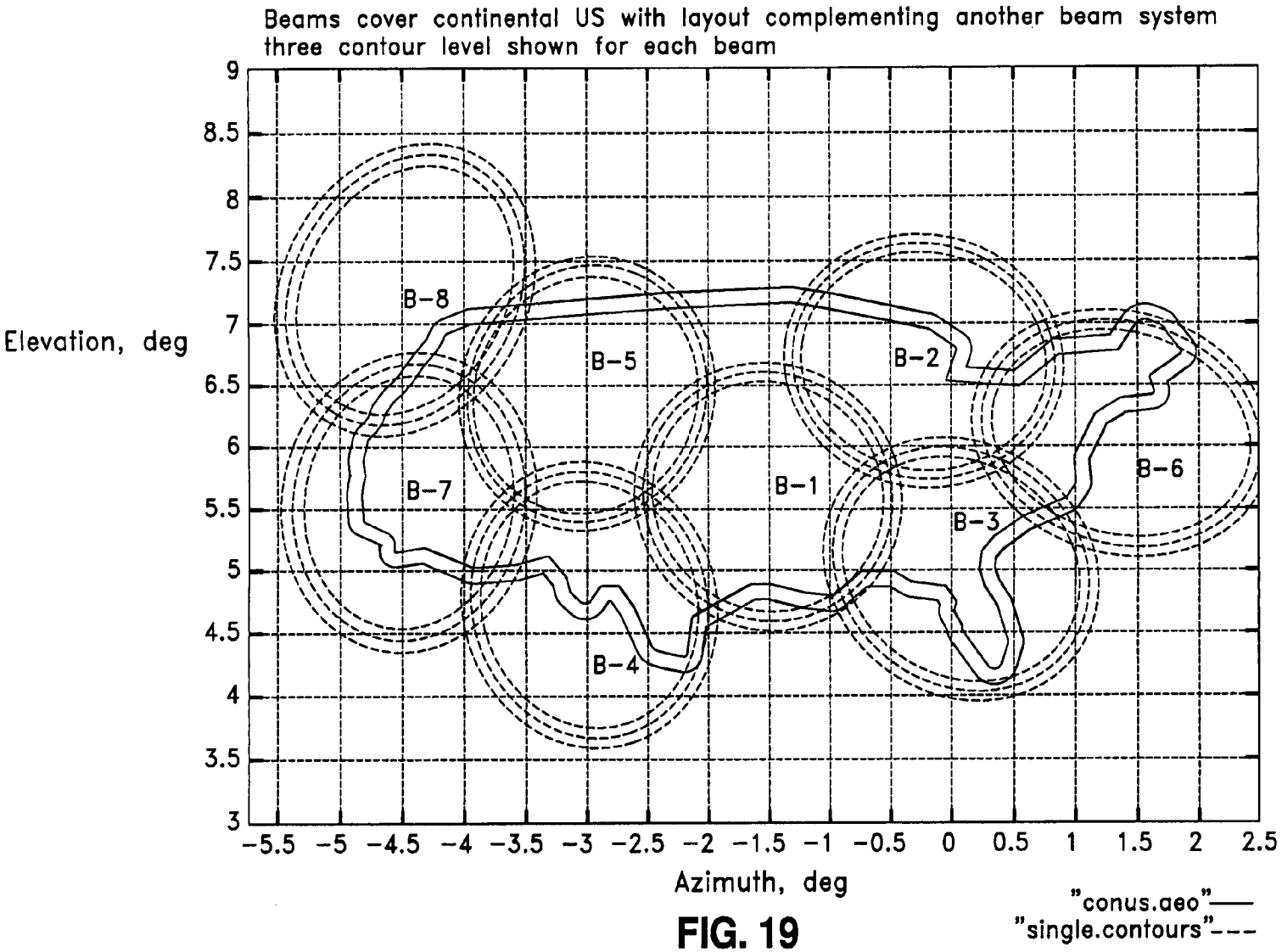
FIG. 19 is a diagram illustrating contours of the beams produced by the antenna system having a single offset reflector.

FIG. 17 shows another embodiment of the present disclosure, in which a single-reflector antenna system 300 is mounted on a spacecraft body 302 with solar arrays. The antenna system 300 includes a single offset main reflector 304 with a hyperboloidal surface, and a feed cluster composed of 8 feeds 306 aimed at the main reflector 304. The feeds 306 independently produce radiating energy illuminating the main reflector 304 to form 8 respective closely spaced or overlapping beams. FIG. 18 illustrates apertures B-1 to B-8 of the feeds 306 projected onto the feed plane. FIG. 19 shows an example of beam contours for the respective feeds B-1 to B-8 to cover the continental United States.

The foregoing description illustrates and describes aspects of the present invention. Additionally, the disclosure shows and describes only preferred embodiments, but as aforementioned, it is to be understood that the invention is capable of use in various other combinations, modifications, and environments and is capable of changes or modifications within the scope of the inventive concept as expressed herein, commensurate with the above teachings, and/or the skill or knowledge of the relevant art.

The embodiments described hereinabove are further intended to explain best modes known of practicing the invention and to enable others skilled in the art to utilize the invention in such, or other, embodiments and with the various modifications required by the particular applications or uses of the invention.

Accordingly, the description is not intended to limit the invention to the form disclosed herein. Also, it is intended that the appended claims be construed to include alternative embodiments.

What is claimed is:

1. A single-aperture, multi-beam antenna system for forming a set of highly-overlapped beams, the system comprising:

multiple feeds, each of which radiates energy, and a hyperboloidal main reflector responsive to the radiated energy for simultaneously forming multiple beams into a predetermined highly-overlapped pattern, the hyperboloidal main reflector having a shaped reflective surface that forms each one of the multiple beams in association with a corresponding one of the multiple feeds, and that collectively forms the multiple beams into the predetermined highly-overlapped pattern, the shaped reflective surface having a hyperboloidal eccentricity, wherein each of the multiple beams has a constant beamwidth as a function of frequency over a predetermined range of operational frequencies.

2. The system of claim 1, wherein the multiple feeds are configured for illuminating the main reflector with the radiated energy.

3. The system of claim 1, further comprising a subreflector configured for being illuminated by the radiated energy produced by the multiple feeds, and for reflecting the radiated energy to the main reflector.

4. The system of claim 1, wherein the main reflector is configured for forming a hexagonal lattice of beams.

5. The system of claim 1, wherein the main reflector is configured for forming pencil beams.

6. The system of claim 1, wherein the main reflector is configured for forming a cluster of overlapping beams.

7. The system of claim 1, wherein a cluster combining all of the multiple feeds in the antenna system is configured so as to illuminate a single antenna reflector with radiated energy.

8. The system of claim 1, wherein the feeds have different aperture diameters.

9. The system of claim 8, wherein the feeds are irregularly spaced.

10. The system of claim 3, wherein the subreflector is an ellipsoidal reflector.

11. The system of claim 3, wherein the subreflector is a hyperboloidal reflector.

12. The system of claim 1, wherein the main reflector and the multiple feeds are configured for deployment on a spacecraft body.

13. The system of claim 1, wherein the main reflector is configured for forming beams covering predetermined surface areas.

14. A single-aperture, multi-beam antenna system for forming a set of highly-overlapped beams, the system comprising:

multiple feeds each of which radiates energy, and an ellipsoidal main reflector responsive to the radiated energy for simultaneously forming multiple beams into a predetermined highly-overlapped pattern, the ellipsoidal main reflector having a shaped reflective surface that forms each one of the multiple beams in association with a corresponding one of the multiple feeds, and that collectively forms the multiple beams into the predetermined highly-overlapped pattern, the shaped reflective surface having an ellipsoidal eccentricity, wherein each of the multiple beams has a constant beamwidth as a function of frequency over a predetermined range of operational frequencies.

15. The system of claim 14, wherein the reflector is configured for forming a hexagonal lattice of circular beams.

16. The system of claim 14, wherein the reflector is configured for forming pencil beams.

17. The system of claim 14, wherein the reflector is configured for forming a cluster of overlapping beams.

18. The system of claim 14, wherein a cluster combining all of the multiple feeds in the antenna system is configured so as to illuminate a single antenna reflector with radiated energy.

19. The system of claim 14, wherein the feeds have different aperture diameters.

20. The system of claim 19, wherein the feeds are irregularly spaced.

* * * * *